United States Patent [19]

Coen et al.

[11] 4,098,443

[45] Jul. 4, 1978

[54] SAMPLE BOOK WITH INTEGRAL HANDLE

[75] Inventors: Manus Coen, Passaic; Joseph Bonfield, Clifton, both of N.J.

[73] Assignee: Eastern Bindery, Inc., Paterson, N.J.

[21] Appl. No.: 731,425

[22] Filed: Oct. 12, 1976

[51] Int. Cl.[2] ..... B65D 71/00

[52] U.S. Cl. ..... 224/45 P; 281/19 R; 402/75

[58] Field of Search ..... 224/45 N, 45 Q, 50, 224/45 P; 190/58 A, 58 R; 402/75, 60, 74, 7; 281/19 R, 19 A, 17, 46, 34, 25 R; 206/450

[56] References Cited

U.S. PATENT DOCUMENTS

| | | | |
|---|---|---|---|
| 1,189,826 | 7/1916 | Jenkins | 281/25 R |
| 1,562,320 | 11/1925 | Farley | 281/25 R |
| 2,177,270 | 10/1939 | Trussell | 281/19 A |
| 2,267,045 | 12/1941 | Russell | 281/25 R |
| 2,291,512 | 7/1942 | Trussell | 281/17 |
| 2,537,750 | 1/1951 | Gretschel | 190/58 A |
| 2,539,757 | 1/1951 | Schaff | 402/60 |
| 2,652,908 | 9/1953 | Fuller | 190/58 R |
| 2,741,495 | 4/1956 | Gould | 281/19 R |
| 3,514,875 | 6/1970 | Howard | 281/19 R |

*Primary Examiner*—Trygve M. Blix
*Assistant Examiner*—Kenneth Noland
*Attorney, Agent, or Firm*—Edward R. Weingram

[57] ABSTRACT

A sample book has an internal spine directly connected to the pages of the book. Mounting projections from the internal spine project through the cover of the book for direct attachment to a pivotally mounted carrying handle.

10 Claims, 22 Drawing Figures

SAMPLE BOOK WITH INTEGRAL HANDLE

BACKGROUND OF THE INVENTION

1. Field of the Invention

This invention relates to sample books and, more specifically, to sample books having handles to facilitate carrying the book.

2. Description of the Prior Art

The makers and users of sample books have long been faced with the problem of providing a sample book which can be easily handled and transported. Sample books, such as those containing wallpaper or other surface coverings, are usually relatively bulky and heavy. Collections of these books are often kept on shelves in showrooms, so that when a person desires to view the book, the book has to be taken from the shelf, carried to a desk or table for viewing, and then returned to the shelf. Often, too, books will be taken from the showroom and transported to the location where the merchandise shown in the books is intended for installation. Because of the nature of the use of sample books as described above, it is important that the books be provided with an effective means for carrying and otherwise handling the books.

Prior attempts to provide a sample book which can be easily handled, transported, and stored have been less than successful. Attempts have been made to place handles on the spine or back surface of the covers of sample books. However, this type of construction resulted in all the weight of the book being borne by the cover of the book, which tended to place too great a stress on the members which fastened the cover to the pages of the book. Therefore, it was common for the cover to separate from the remainder of the book, making the book unusable.

Attempts have been made to fasten one or more straps to the front and back cover of the book, across the spine of the book, in order to serve as a handle. However, this type of handle is inherently unbalanced when supporting the book. For example, when the book is being carried, the handle will tend to lie in the plane of the palm of the hand of the person carrying the book. This is normally parallel to the path of movement of the adjacent leg of the person when he is walking. Therefore, when a book with the crossover strap is carried, the book tends to rotate, so that at least one end of the book projects into the path of movement of the person's leg, causing a constant bumping of the knee against the book. Other attempts at providing a sample book with a convenient handle means have resulted in constructions which interfere with normal use of the book. One example of such construction is where the handling means consists of one handle member extending beyond the spine of the book on either side of the front and back covers, which are usually secured to the book through the cover. However, this type of handle usually cannot be easily moved to a position where it will not interfere with the placing of the book on a flat surface in order to properly view the contents of the book. Instead, the handles usually protrude, making the book somewhat unstable when placed on a table.

Another example of a construction which interferes with the normal function of the book, that in which the cover of the book is designed to serve as the main weight-bearing structure of the book, and the handle is then mounted directly onto the cover. In such circumstances, because the cover serves as the main weight-bearing member for the book, the cover requires a relatively large apron or non-opening segment on the front and/or the back portion. This non-opening segment will prevent the book from lying flat when opened. Accordingly, the large apron, or non-opening section, of the cover will restrict the turning freedom of the pages held in the cover and, therefore, reduce the area of each page in the book that can be effectively and conveniently viewed by the person using the book.

SUMMARY OF THE INVENTION

In order to overcome the problems of the prior art, the present invention sets forth a sample book which is constructed with an internal spline directly connected to the pages of the book. Mounting means project through the cover of the book disposed about the spline, to provide for direct pivotal attachment of a handle to the internal spline to support the pages of the book. The fastening of a handle to the mounting means from the internal spline effectively positions the cover with relation to the pages of the book and the internal spline.

Accordingly, in view of the above, it is an object of the present invention to provide a sample book which includes a handle that is securely anchored into the binding of the book and does not rely upon attachement to the cover of the book for its primary support.

It is another object of the present invention to provide a sample book having a handle which is securely fastened to the book with a minimum of external connecting members.

Still another object of the present invention is to provide a sample book having a handle which is relatively flexible and can be moved between a carrying position and a rest position without any difficulty and will produce minimal interference with the use of the book when the book and handle are both laid in the flat position.

It is yet another object of the present invention to provide a sample book having a handle in which the handle is balanced with relation to the book, so that the book can be easily carried without banging or jostling.

A further object of the present invention is to provide a sample book having a handle which does not put excessive strain on the cover to support the book when the book is being carried.

It is an additional object of the present invention to provide a sample book having a handle which does not interfere with the binding of the book so as to prevent the free opening of the pages in the book.

Another object of the present invention is to provide a sample book having a handle which is not anchored directly to the cover of the book.

It is still another object of the present invention to provide a sample book having a handle which does not detract from the binding qualities of the book.

Yet another object of the present invention is to provide a sample book having a handle which is of a durable construction.

It is a further object of the present invention to provide a sample book having a handle which can be easily fabricated.

An additional object of the present invention is to provide a sample book having a handle which can be fabricated relatively inexpensively.

It is another object of the present invention to provide a sample book having a handle in which the handle and the handle connection are relatively strong.

Still another object of the present invention is to provide a sample book having a handle, in which the handle is relatively comfortable.

Other objects and advantages will be apparent from the following description of several embodiments of the invention, and the novel features will be particularly pointed out hereinafter in connection with the appended claims.

DESCRIPTION OF THE PREFERRED EMBODIMENTS

Figure 1:
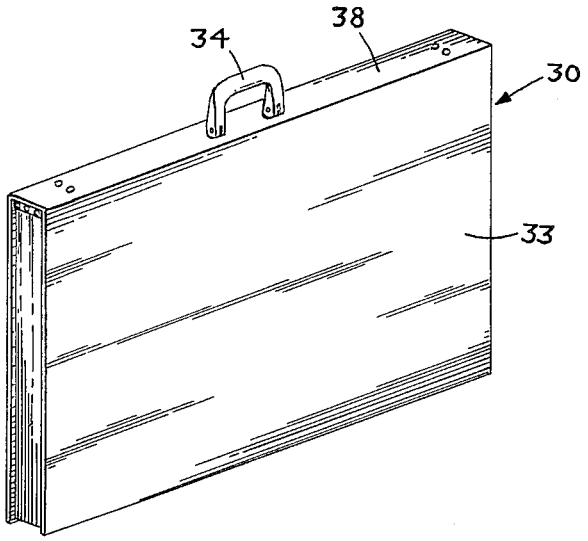
FIG. 1 is a perspective view of a sample book built in accordance with the teachings of the present invention.
Figure 2:
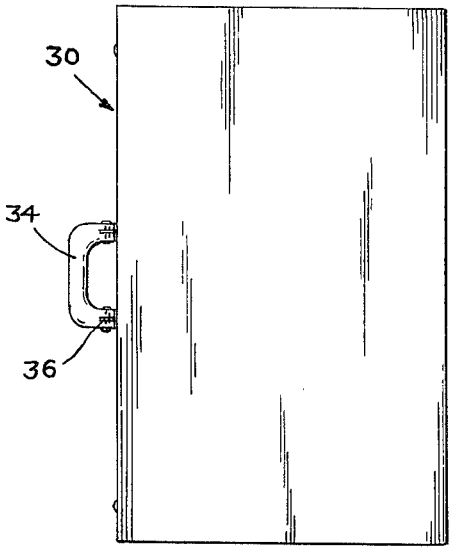
FIG. 2 is a front elevation of the book shown in FIG. 1.
Figure 3:
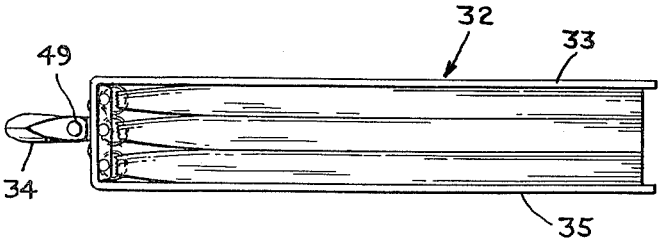
FIG. 3 is an end view of the book shown in FIG. 1.

Referring to FIGS. 1 through 12*a*, a sample book generally indicated at 30, composed of several page groups or leaf bundle 64 has a cover 32 with front and back leaves 33 and 35 respectively, and a spine section 38. A handle 34 is positioned above the spine portion 38 by attachment to fingers 46 extending upward from an internal spine 44 through slots 40 in the spine portion 38 of the cover.

Figure 12:
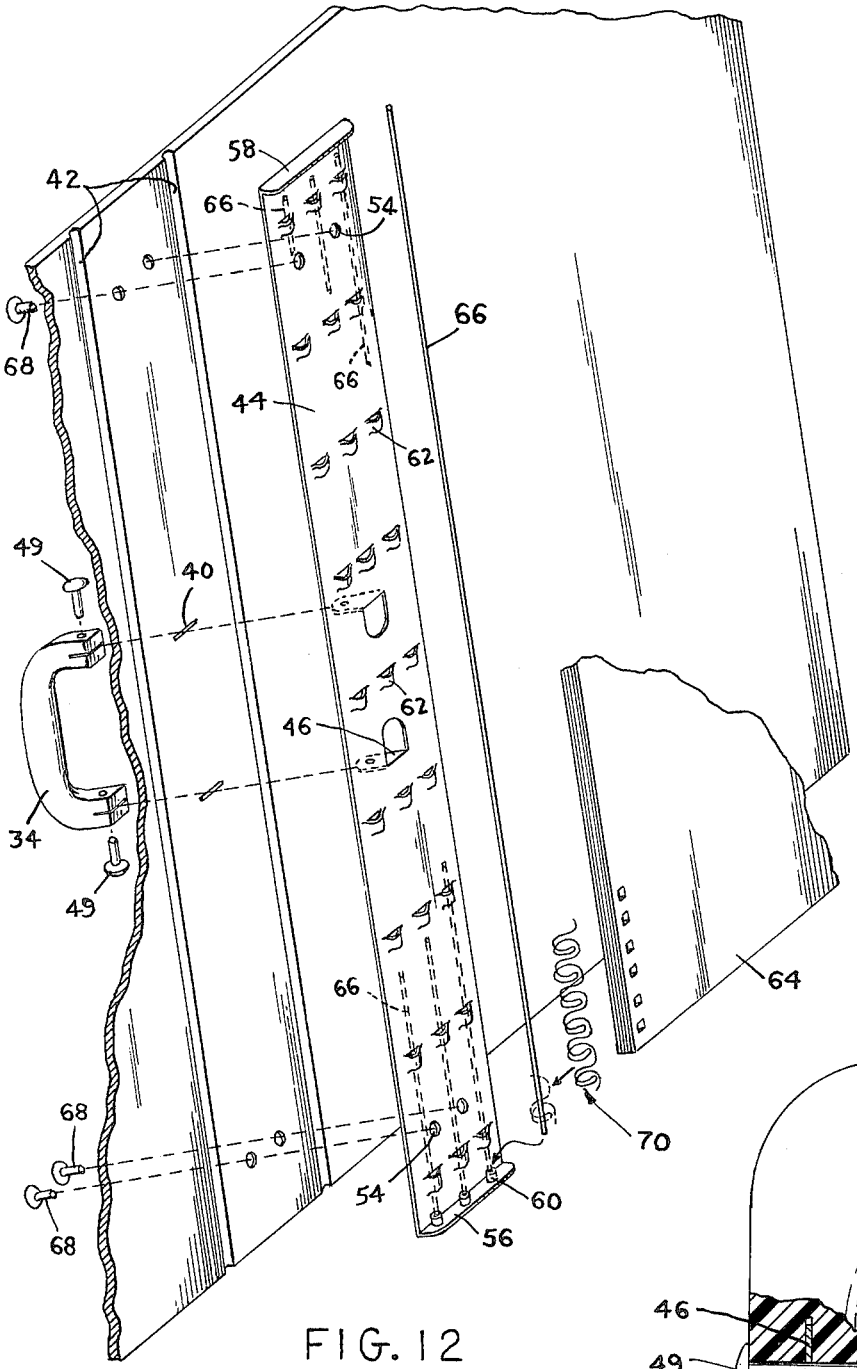
FIG. 12 is an exploded view of the book shown in FIG. 1.
Figure 12A:
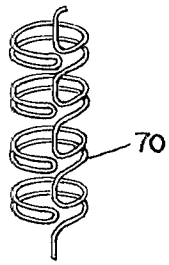
FIG. 12*a* is an enlarged view of the wire binding used to bind the segments of the book shown in FIG. 1.
Figure 6:
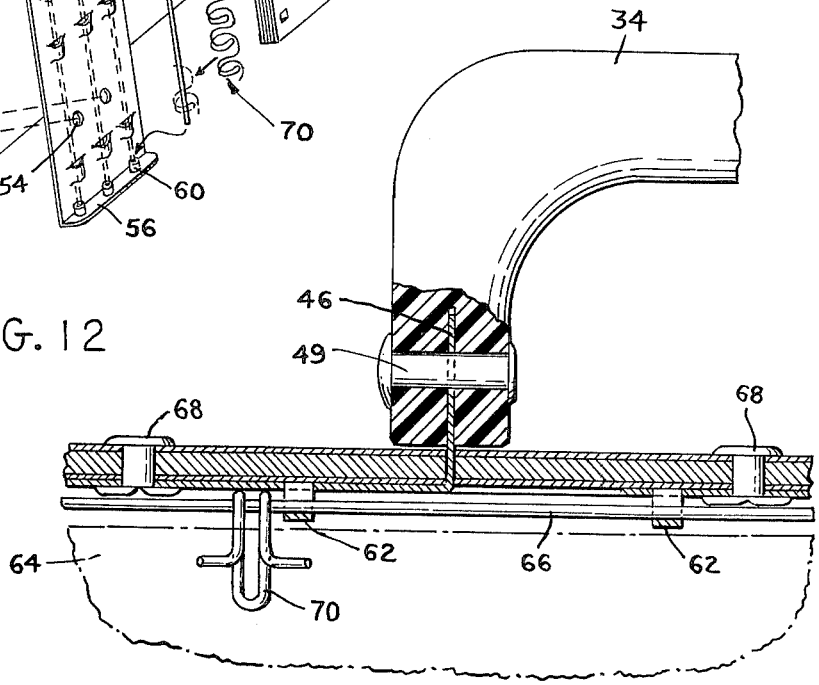
FIG. 6 is a view taken along lines 6—6 of FIG. 5.
Figure 13:
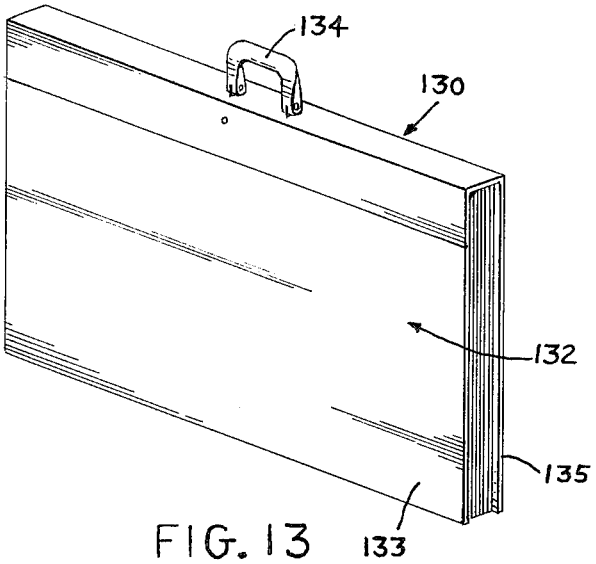
FIG. 13 is a perspective view of another embodiment of a book built in accordance with the teachings of the present invention.
Figure 14:
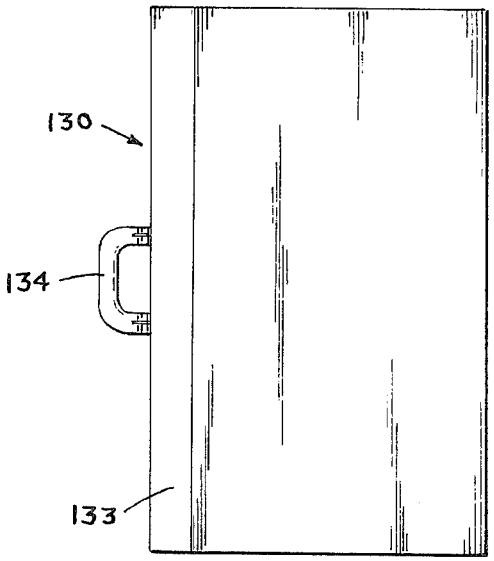
FIG. 14 is a front elevation of the book shown in FIG. 13.
Figure 15:
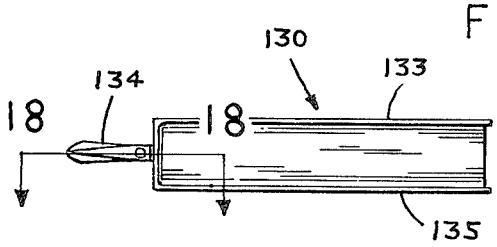
FIG. 15 is an end view of the book shown in FIG. 13.
Figure 17:
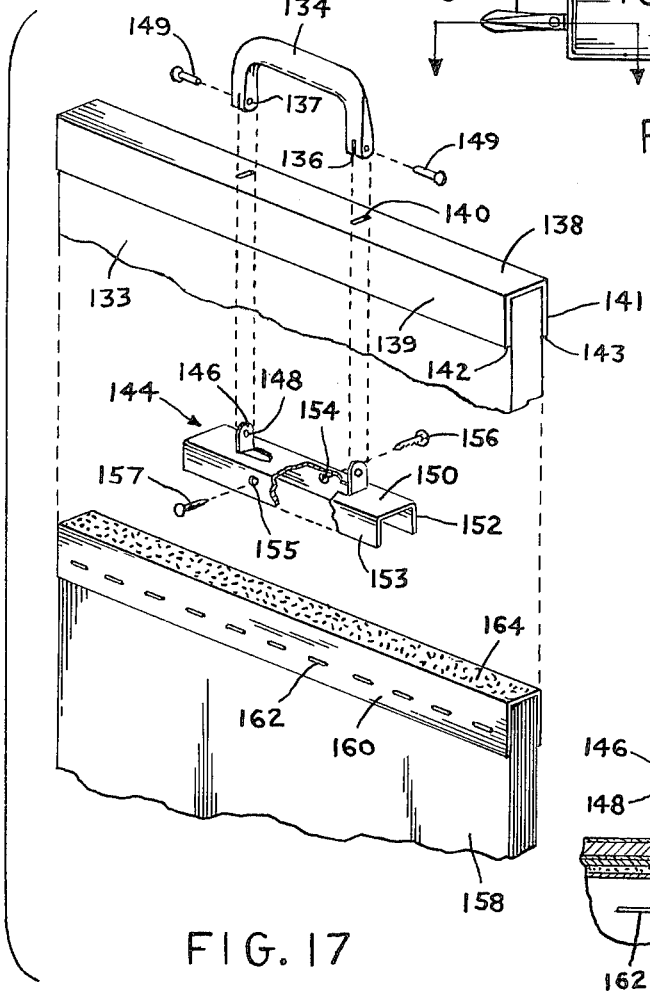
FIG. 17 is an exploded view of a portion of the book shown in FIG. 13.
Figure 16:
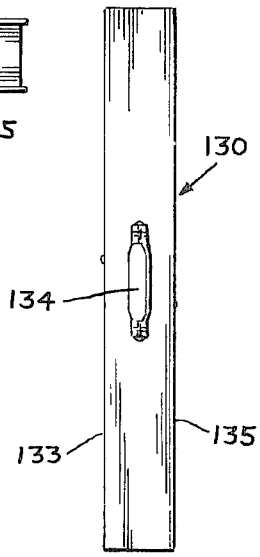
FIG. 16 is a top view of the book shown in FIG. 13.
Figure 18:
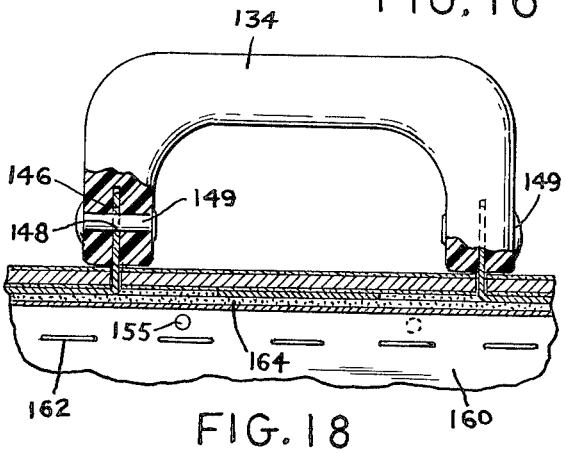
FIG. 18 is a view along lines 18—18 of FIG. 15.

As shown most clearly in FIGS. 6 and 12, the fingers 46 extending upward from the spine pass through the slots 40 in the spine 38 of the cover and fit into slots 36 cut in the bottom of each end of the handle. Corresponding rivet holes 37 in the handle 48 and in fingers 46 allow for the insertion of rivets 49 through the handle and fingers, to pivotally fix the handle with relation to the internal spine 44.

Figure 4:
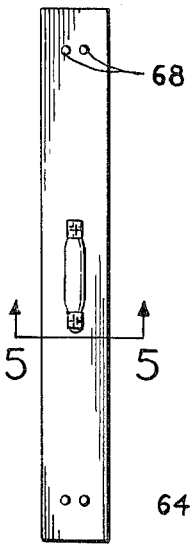
FIG. 4 is a top view of the book shown in FIG. 1.
Figure 5:
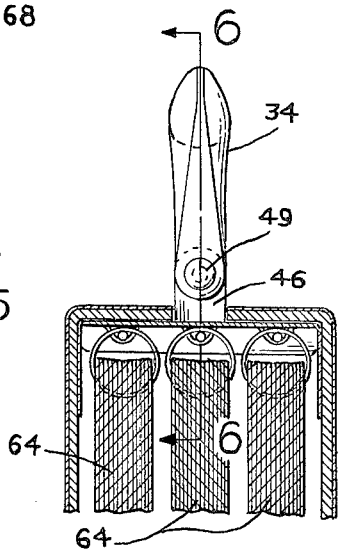
FIG. 5 is a view taken along lines 5—5 of FIG. 4.
Figure 7:
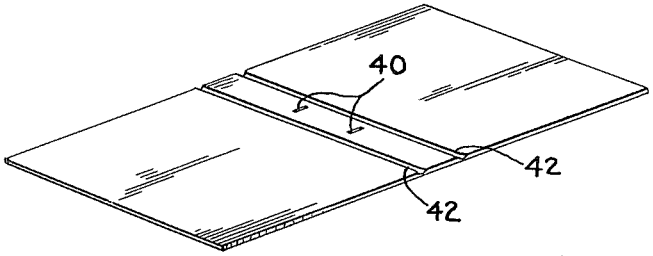
FIG. 7 is a perspective view of the cover used for the book shown in FIG. 1, with the cover in the open position.

The inner spine 44 is fastened to the spine 38 of the cover by means of fastening holes 54 at either end of the spine. Of course, other means could be used beside rivets to fasten the spine to the cover, such as nailing or bonding. FIG. 4 shows the rivets 68 which are used at either end of the spine 38 of the cover 32 to fasten to spine 44 through the holes 54 therein.

The page groups 64 are fastened to the spine 44 by means of a fastening rod 66 which extends through the "wire-0" type wire binding 70 of each page group 64, and also through the row of rod loops 62 extending from the bottom surface 52 of spine 44.

Access for rods 66 to the rod loops 62 in spine 44 is provided by means of rod passages 60 in the right end skirt 56 of spine 44. The rods 66 are approximately equal in length to the spine 44, so that when fully inserted they will come close to the left end skirt 58 of the spine. The rod passages 60 are then plugged in any convenient manner in order to capture the rod within the rod loops 62 thereby securely fastening the page group 64 to the spine.

Figure 8:
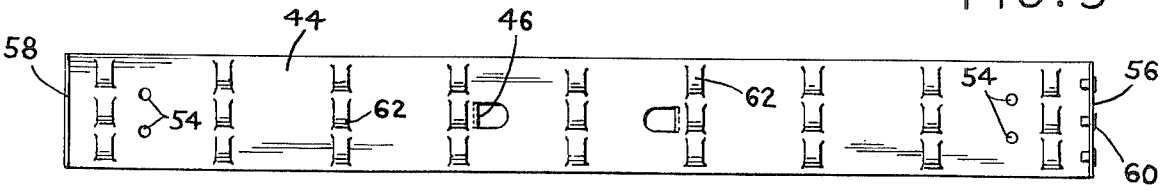
FIG. 8 is a top view of the spline member of the book shown in FIG. 1.
Figures 9, 10:
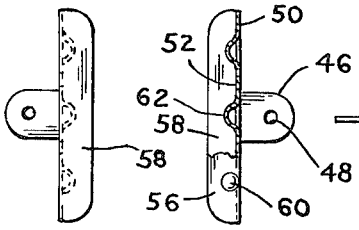
FIG. 9 is a left end view of the spline shown in FIG. 8.
FIG. 10 is a right end view of the spline shown in FIG. 8, partially broken away.
Figure 11:
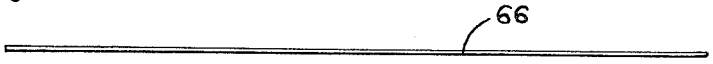
FIG. 11 is a rod used in forming the binding of the book shown in FIGS. 1 through 4.

The spine 44 shown in FIG. 8 has three rows of rod loops and therefore would hold three page groups 64.

As can be seen from the above description, the finished product is a strongly constructed book, having a stiff spine from which are securely fastened the pages of the book. The handle 34 is connected directly to the spine and not in any way to the cover of the book, so that any use of the handle will not impart a stress to the cover of the book. The front and back leaves of the cover 33 and 35 respectively are free to swing freely on hinge lines 42 to open wide, allowing the book to lie flat when placed on a flat surface. For even greater rigidity, the top surface 50 of spine 44 could be bonded to the bottom of the cover spine 38, but this is in no way necessary to add to the strength of the sample product.

ANOTHER EMBODIMENT OF THE INVENTION

Referring now to FIGS. 13 through 18, a book, generally indicated at 130 consists of a page bundle or leaf bundle 158, surrounded by a cover generally indicated at 132 having front and back leaves 133 and 135 pivoting along hinge lines 142 and 143 respectively from aprons 139 and 141 respectively, which in turn are continuous with spine portion 138 of the cover.

A handle 134 is mounted to a spine member generally indicated at 144 by means of fingers 146 extending upward from the spine through corresponding slots 140 in the spine 13 of cover 132. The fingers 146 extending from internal spine 144 mate with slots 136 in the end of each handle and are fastened in the slots by means of rivets 149 which pass through aligned fastening holes 148 in the fingers 146 extending from internal spine 144 and rivet holes 137 in the ends of the handle.

Internal spine 144 has a back surface 150 and front and back arms 152 and 153 respectively extending downward to form a "U" shape. The spine is adapted to fit over the cover sheet 160 that surrounds the back of page bundle 158. The page bundle is securely fastened by means of wire stitching 162 to form a fastened integral unit. A layer of adhesive 164 can be placed on the back of cover sheet 162 as an aid in assembly of the book and to prevent relative movement of parts after final assembly, although this layer of adhesive is not necessary.

To assemble the book, the internal spine member 144 is placed over the stitched page bundle. Nails 157 and 156 can then be passed through the front and rear arms respectively of internal spine 144 to fasten the spine to the page bundle. The cover 132 can then be placed over the page bundle and fastened internal spine, so as to have fingers 146 extend through the corresponding slots 140 in the spine 138 of the cover. The handle 134 is then fitted over the extended fingers, and rivets 149 installed to lock the handle to the internal spine, thereby also locking the cover in position. In this position, the cover would be free to open completely, regardless of the binding method used for the page bundle. For example, the hinge lines for the cover leaves could be at the end of spine 138 rather than at the end of the apron. However, this would allow all of the binding stitching and other items to clearly show, which may be considered undesirable.

Alternatively, the book may be assembled by placing the internal spine 144 over the secured page bundle 158 and then placing the cover over the internal spine to register the slots 140 on the cover spine 138 with the fingers 146 extending from the inner spine. After that operation is completed, the cover can be fastened to the internal spine and the internal spline in turn fastened to the secured page bundle 158 at the same time driving the connecting nails 156 and 157 through the aprons 139 and 141 of the cover and into the arms 153 and 152 of the internal spine member.

Note the handle 134 is pivotally fastened to the fingers 146 in the same manner as in the previous embodiment by means of rivets 149 passing through aligned passages 137 and 148 in the handle and spine fingers respectively.

Nail holes 157 and 154 can be formed in the arms 153 and 152 of internal spine 144 to facilitate the passing of the nail through the spine on into the page bundle 158.

It should be apparent that in the second embodiment of the invention as in the first, once again the handle directly supports the page bundle of the book and does not rely upon any connection with the cover of the book in order to provide support. Any connection between the internal spine 144 and the cover 132 of the book is only to prevent relative motion between these two elements which might be disconcerting to the user of the book and also to mask the binding of the page bundle.

A THIRD EMBODIMENT OF THE INVENTION

Figure 19:
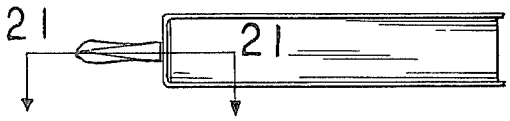
FIG. 19 is an end view of another embodiment of a book built in accordance with the teachings of the present invention.
Figure 20:
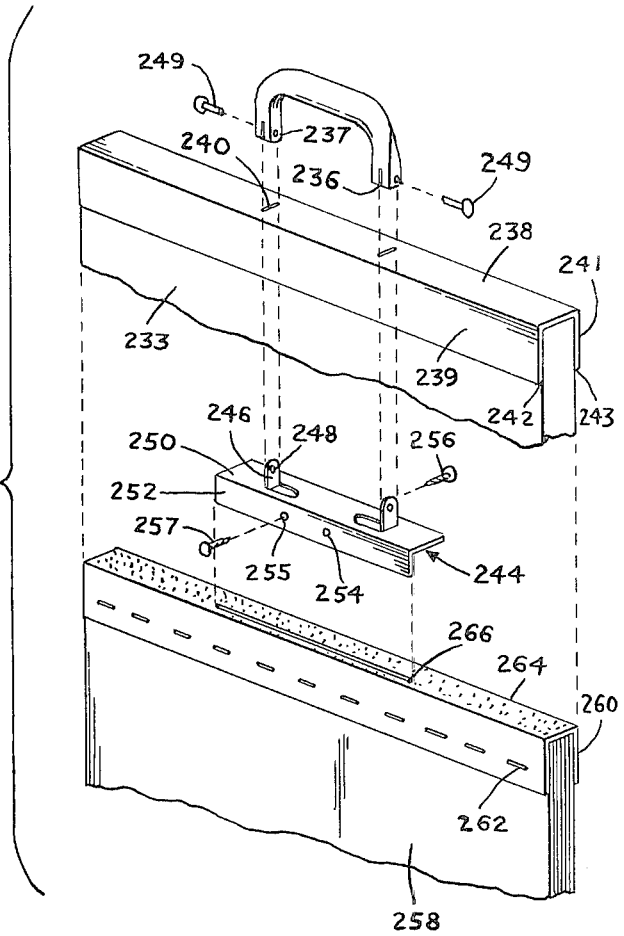
FIG. 20 is an exploded view of a portion of the book shown in FIG. 19.
Figure 21:
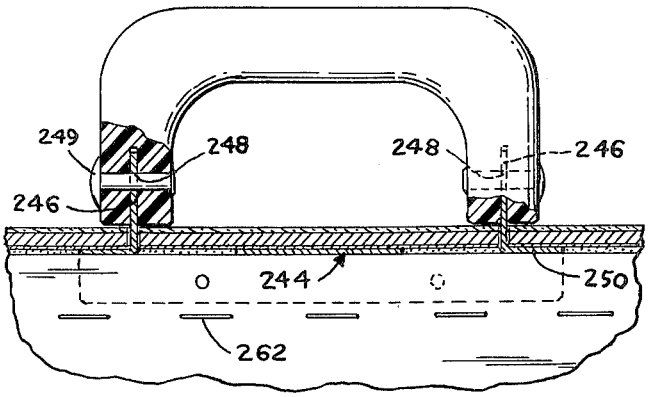
FIG. 21 is a view along lines 21—21 of FIG. 19.

A third embodiment of the invention is shown in FIGS. 19 through 21. In this embodiment, a book generally indicated at 230 having a cover generally indicated at 232 has a handle 234 which is secured to fingers 246 extending through slots 240 in the spine 238 in the cover from an internal spine 244. The handle 234 is again fastened to the fingers extending from the internal spine by means of rivets 249 which pass through aligned rivet holes 237 in the handle and 248 in the fingers.

Internal spine 244 differs from the previous embodiment in that it has only one arm member 252 and a back member 250 from which the fingers 246 extend. The single arm member 252 extends downwardly between the leaves of the leaf bundle 258 or into a groove or receptacle 266 in the back of the page bundle or leaf bundle 258. Note that the bottom of the arm 252 extends above the line of stitching 262 of the page bundle. In this manner, the inner spine 244 can always be positioned with respect to the fastened page bundle 258 so that the extended fingers 246 will be centrally positioned with respect to the page bundle and therefore provide a balanced assembly.

Assembly of the book is the same as in the last-mentioned embodiment, with the option being given of either fastening the inner spine 244 to the assembled page bundle 258 prior to, or after, insertion of the fingers 264 through the corresponding slots 240 in the spine 238 of the cover 232.

From the above description of the invention, several advantages of the invention should be apparent. All of the books described have a handle which can be perfectly positioned and aligned on the spine of the cover so that the book will be in perfect balance when being carried by a person. The book would not have a tendency to swing into the path of the person's leg as he walked, nor would it have a tendency to drop the front or rear position because of the uneven position of the handle.

Further, the fingers extending through the spine of the book extend only far enough to allow for mounting of the handle with a small amount of clearance space. Therefore, when the book is laid flat on a table and the handle placed in the flat position, the book is relatively stable, and will not have a tendency to rock back and forth as pages are turned, as would be the case if the handle were of a much larger projection than in the present case.

Note also that since the handle can be easily turned to the side in a relatively flat position with relation to the spine of the books, that the books can be more easily stored in a shelf area without numerous projections extending beyond the storage shelves, which projections may post hazards to personnel who have to work in the proximity of the shelves.

Obviously, the construction of the book and handle assembly offers many distinct advantages. First, the handle is securely fastened directly to the strongest member in the assembly, namely the internal spine member. The handle does not in any way depend on the cover for any of its mounting strength. The cover can be fastened directly to the back of the page bundle by means of any convenient bonding agent or other means, if desired, solely for the purpose of immobilizing the cover, since any movement between the cover and the pages would be disconcerting to the user of the book.

Additionally, by freeing the cover from any load-bearing responsibility with relation to the handle of the book or the means for carrying the book, the cover can be spread more freely and, therefore, open to a wider extent than is normally possible with the covers of existing sample books. Further, the increased spreadability of the cover can allow for easier and increased spreadability of the pages in the book. This, therefore, provides for a more effective presentation of the material on the page and, in effect, a larger viewing area of each page in the book.

It should also be pointed out that the assembly of the book as described above is relatively quick, requiring a minimum of precision steps and a minimum of time-consuming steps. Therefore, it is relatively inexpensive and can be accomplished by personnel with a minimum of skill in this art.

It will be understood that various changes in the details, materials and arrangements of parts which have been herein described and illustrated in order to explain the nature of the invention may be made by those skilled in the art within the principle and scope of the invention, as expressed in the appended claims.

What is claimed is:

1. A sample book comprising:
a page bundle;
an internal spine;
fastening means, fastening said internal spine to said page bundle;
a cover having a spine with passage means therein said cover disposed about said internal spine so as to position said internal spine between said cover and said page bundle;
mounting means on said internal spine extending away from said page bundle through said passage means in said cover;
handle means;
means connecting said handle means to said mounting means on said internal spine externally of said cover means so that said handle means is connected to said pages of said book through said internal spine; and
said mounting means comprise a pair of spaced fingers which are formed from the body of said internal spine that extends parallel to said cover provided with said passage means.

2. A sample book according to claim 1 wherein said means for fastening said internal spine to said page bundles comprise:
a plurality of receptacles for rods formed in said spine;
a rod adapted to pass through said rod receptacles;
a wire-type of binding forming a plurality of pages into said page bundles;
said rod extending through said wire-type binding and through said rod receptacles to fasten said page bundle to said internal spine.

3. A sample book according to claim 2 further comprising:
downwardly projecting skirt means on both ends of said internal spine;
rod passages formed in the skirt at one end of said internal spine for passing said rod through said rod receptacles extending from said spine.

4. The sample book according to claim 3, wherein;
said mounting means on said internal spine extending through said cover comprise:
said fingers having passages formed therein perpendicular to the direction of the extension of said fingers for receiving fastening means therein; and
wherein said means connecting said handle means to said mounting means on said internal spine comprise:
a pair of arms formed on said handle;
in each of said arms on said handle a passage formed, dimensioned to register with the passage means in said fingers extending from said internal spine for pivotally fastening said handle to said fingers extending from said internal spine.

5. The sample book according to claim 1 wherein said internal spine comprises:
a back surface;
a pair of fingers extending upward from said back surface adapted to engage the handle for said book;
at least one downwardly extending arm from said back surface adapted to be fastened to said page bundle of said book.

6. The sample book according to claim 5 wherein said means to fasten said downwardly extending arm into said page bundle of said book comprise nail means passing through said downwardly extending arm and said page bundle of said book in a path parallel to the back surface of said internal spine.

7. The sample book according to claim 1 wherein:
said mounting means on said internal spine extending through said cover comprise:
said fingers having passages formed therein perpendicular to the direction of the extension of said fingers for receiving fastening means therein; and
wherein said means connecting said handle means to said mounting means on said internal spine comprises:
a pair of arms formed on said handle;
in each of said arms on said handle, a passage formed, dimensioned to register with the passage means in said fingers extending from said internal spine for pivotally fastening said handle to said fingers extending from said internal spine.

8. The sample book according to claim 7 wherein said means connecting said handle means to said mounting means further comprise slot means in each arm of said handle, disposed perpendicular to said fastener passage means in said handle said dimensioned to receive said mounting fingers extending from said internal spine means.

9. A sample book comprising:
a page bundle;
an internal spine;
fastening means, fastening said internal spine to said page bundle;
a cover having a spine with passage means therein, said cover disposed about said internal spine;
mounting means on said internal spine extending through said passage means in said cover;
handle means;
means connecting said handle means to said mounting means on said internal spine so that said handle means is connected to said pages of said book through said internal spine;
said internal spine comprising:
a back surface;
a pair of fingers extending upward from said back surface adapted to engage the handle for said book;
at least one downwardly extending arm from said back surface adapted to be fastened to said page bundle of said book;
said means to fasten said downwardly extending arm into said page bundle of said book comprise nail means passing through said downwardly extending arm and said page bundle of said book in a path parallel to the back surface of said internal spine;
said page bundle is secured by means of a line of stitching disposed parallel to the upper end of said page bundle proximate said internal spine;
said page bundle includes a receptacle formed in the end of said page bundle adjacent said internal spine;
said arm extending into said receptacle in said page bundle, and fastened therein by means of said nail means.

10. The sample book according to claim 9, wherein:
said mounting means on said internal spine extending through said cover comprise:
a pair of fingers extending in parallel relation from said internal spine;
said fingers having passages formed therein perpendicular to the direction of the extension of said fingers for receiving fastening means therein; and wherein said means connecting said handle means to said mounting means on said internal spine comprise:

a pair of arms formed on said handle;

in each of said arms on said handle a passage formed, dimensioned to register with the passage means in said fingers extending from said internal spine for pivotally fastening said handle to said fingers extending from said internal spine.

* * * * *